US005704314A

United States Patent [19]

Allmendinger et al.

[11] Patent Number: 5,704,314

[45] Date of Patent: Jan. 6, 1998

[54] ELECTROMAGNETIC OPERATING ARRANGEMENT FOR INTAKE AND EXHAUST VALVES OF INTERNAL COMBUSTION ENGINES

[75] Inventors: Richard Allmendinger, Stuttgart; Thomas Hardt, Weinstadt; Robert Kekenj, Berglen, all of Germany

[73] Assignee: Daimler-Benz AG, Stuttgart, Germany

[21] Appl. No.: 795,516

[22] Filed: Feb. 5, 1997

[30] Foreign Application Priority Data

Feb. 24, 1996 [DE] Germany ..... 196 07 019.8

[51] Int. Cl.[6] ..... F01L 9/04

[52] U.S. Cl. ..... 123/90.11; 251/129.01; 251/129.1; 251/129.16

[58] Field of Search ..... 123/90.11; 251/129.01, 251/129.02, 129.07, 129.1, 129.15, 129.16

[56] References Cited

U.S. PATENT DOCUMENTS

| | | | |
|---|---|---|---|
| 4,794,890 | 1/1989 | Richeson, Jr. | 123/90.11 |
| 4,867,111 | 9/1989 | Schneider et al. | 123/90.11 |
| 5,131,624 | 7/1992 | Kreuter et al. | 123/90.11 |
| 5,199,392 | 4/1993 | Kreuter et al. | 123/90.11 |
| 5,548,263 | 8/1996 | Bulgatz et al. | 123/90.11 |

FOREIGN PATENT DOCUMENTS

| | | |
|---|---|---|
| 35 13 107 | 10/1986 | Germany . |
| 43 36 287 | 3/1995 | Germany . |

*Primary Examiner*—Weilun Lo
*Attorney, Agent, or Firm*—Klaus J. Bach

[57] ABSTRACT

In an electromagnetic operating arrangement for actuating the intake and exhaust valves of an internal combustion engine wherein a valve operating member is movably supported in axial alignment with a valve stem and engaged by an operating member spring which biases the valve operating member into engagement with the valve stem, the valve operating member has an armature disc movably supported thereon but held in engagement with a stop on the valve operating member by a spring arrangement which exerts a spring force smaller than the spring force exerted by the valve operating member spring but greater than the resultant of the valve closing and the valve operating springs such that the valve operating member is always in force-transmitting contact with the valve.

6 Claims, 2 Drawing Sheets

ELECTROMAGNETIC OPERATING ARRANGEMENT FOR INTAKE AND EXHAUST VALVES OF INTERNAL COMBUSTION ENGINES

BACKGROUND OF THE INVENTION

The invention relates to an electromagnetic operating arrangement for intake and exhaust valves of internal combustion engines wherein each valve is provided with an armature and two driving magnets are arranged at opposite sides of the armature which retain the valve in its open and, respectively, closed positions.

This type of valve operating mechanisms require precise adjustment in order to prevent operational problems or eventually failure because of manufacturing tolerances, heat expansions and wear.

DE 35 13 107 A1 discloses an electromagnetically operated control mechanism in which control elements with a spring mechanism are operated between two end positions. In this mechanism an armature is moved by two control magnets to a closing and opening position as desired. The movement of the armature is transmitted, by means of a shaft which is held in engagement with the armature by a spring mechanism, to a valve shaft abutting the armature shaft.

It is however, a disadvantage with this mechanism that, in the valve closing position of the armature, the armature shaft can lift off the valve shaft because of thermal length changes of the cylinder head portions around the control mechanism whereby the opening control mechanism is time-delayed when the armature is to assume a valve opening position so that the valve shaft is lifted only insufficiently out of the valve closing position. Depending on the prevailing temperature conditions, this leads to undefined opening states of the valve control mechanism and, consequently, to undetermined intake and discharge amounts of the medium whose intake into, and discharge from, a chamber is to be controlled by the control mechanism.

DE 43 36 287 discloses a mechanism for the electromagnetic operation of gas intake and exhaust valves for internal combustion engines of motor vehicles. This mechanism includes an armature mounted on the valves and two control magnets arranged at opposite sides of the armature and adapted to hold the valve in its open and closed positions. There are further provided one or several locking elements which engage the control magnet responsible for the valve closing position in such a way that the control magnet is adjustable when the valve is closed and the locking elements are in a released position thereby to provide a length adjustment for a play-free operation of the valve operating mechanism.

With these known mechanisms, the operating magnets effecting the closing of the valves can be adjusted so that the armature always engages the engagement surface, that is, the pole surface of the magnet body of the control magnet.

However, the arrangements require relatively expensive hydraulic control means in order to make sure that the lock grip on the control magnets is released at the exactly correct point in time during the engine combustion stroke.

The arrangement as disclosed in DE 43 36 287 has further the disadvantage that, during engine idle operation, the combustion chamber pressures may not be sufficient to hold the valves in their closed positions when the locking grip on the valves is released so that an adjustment of the control magnets cannot be obtained under such operating conditions.

It is therefore the object of the present invention to provide an electromagnetic operating mechanism for intake and exhaust valves of internal combustion engine wherein exactly defined opening condition are provided independently of length changes in the valve drive.

SUMMARY OF THE INVENTION

In an electromagnetic operating arrangement for actuating the intake and exhaust valves of an internal combustion engine wherein a valve operating member is movably supported in axial alignment with a valve stem and engaged by an operating member spring which biases the valve operating member into engagement with the valve stem, the valve operating member has an armature disc movably supported thereon but held in engagement with a stop on the valve operating member by a spring arrangement which exerts a spring force smaller than the spring force exerted by the valve operating member spring but greater than the resultant of the valve closing and the valve operating springs such that the valve operating member is always in force-transmitting contact with the valve.

The arrangement according to the invention has the advantage that a valve will always reach its closing position by the relative movement of the armature with respect to the control member.

Since, as a result of the cooperation of operating member for the valve with the spring arrangement disposed between the operating member and the armature, the arrangement according to the invention is self-adjusting and therefore does not require any additional control measures.

The arrangement consequently also has the advantage of a simple design resulting in correspondingly low manufacturing costs.

Further advantages and various embodiments of the invention will be described below on the basis of the accompanying drawings:

DESCRIPTION OF PREFERRED EMBODIMENTS

Figure 1:
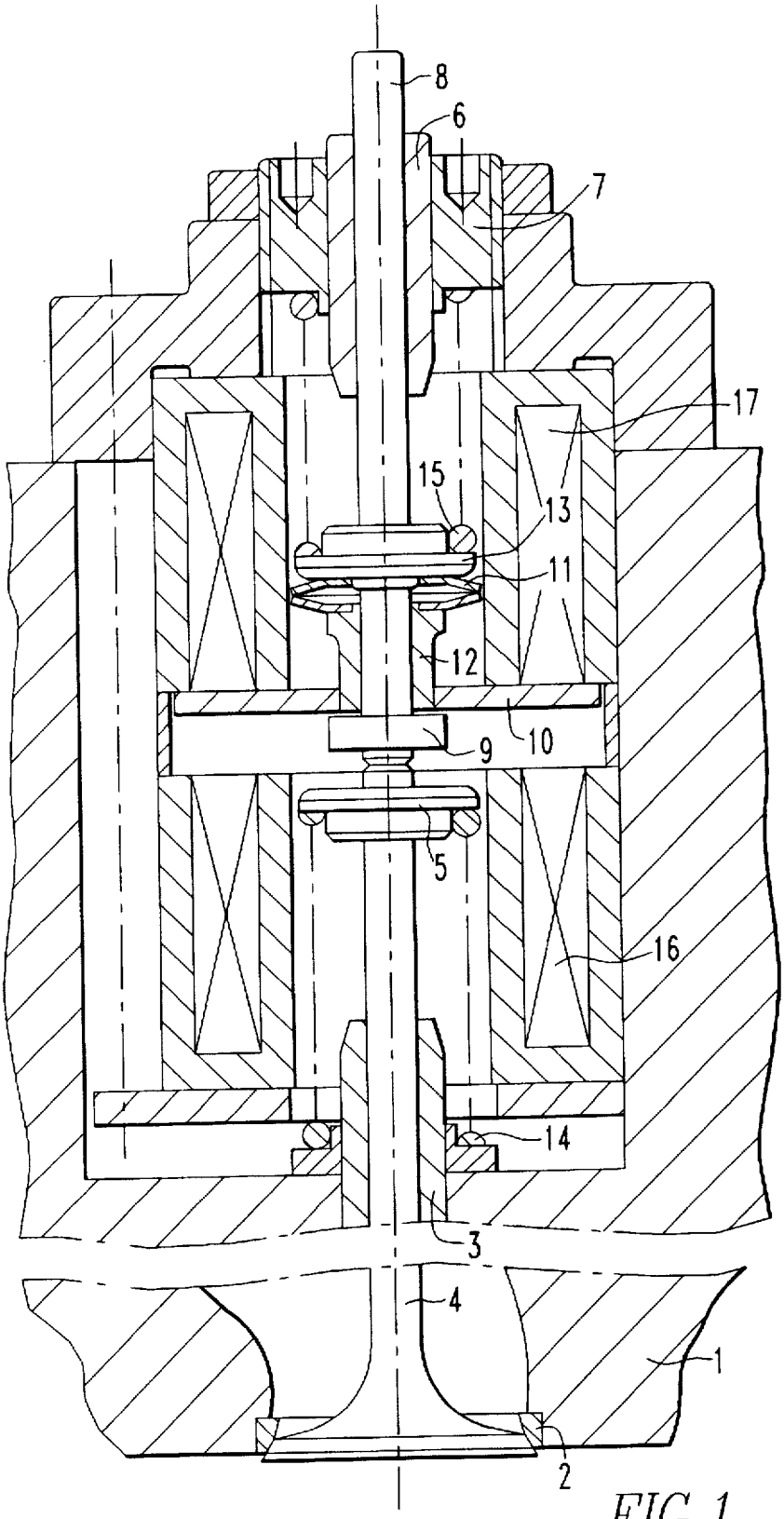
FIG. 1 is an enlarged cross-sectional view of an electromagnetic valve operating arrangement according to the invention with pot-like control magnets.

FIG. 1 shows an arrangement for the electromagnetic operation of intake and exhaust valves of an internal combustion engine which is of common design such that only essential components of the engine are described herein.

As shown in FIG. 1, a cylinder head 1 includes a valve seat ring 2 and a valve guide 3 for supporting a valve 4. The valve 4 has a valve spring support washer 5 mounted thereon by means of wedge members which however are not shown in the drawings as they are commonly used for mounting the valve spring support washers.

In axial alignment with the valve 4, the cylinder head 1 includes a guide sleeve 6 which is supported in an upper spring support member 7 and which slidingly receives an operating member 8 serving as an operating rod for a disc-like armature 10. The operating member 8 has an adjustable stop 9 removably mounted on its end adjacent the valve 4 such that the stop 9 abut the disc-like armature 10. The armature 10 is supported movably with respect to the operating member 8 and is biased against the stop 9 by the spring arrangement 11 with a predetermined force. The axial movability of the disc-like armature is therefore limited by the spring arrangement 11 and the stop 9.

As shown in FIG. 1, the spring arrangement 11 comprises one or several Belleville springs 11 which are used for the embodiment shown as they can be better accommodated than for example coil springs. They are quite suitable for a length adjustment of the valve operating mechanism for play-free valve operation as this application requires only small spring travel.

The disc-like armature 10 has a spacer sleeve 12 connected thereto for guiding and supporting the Belleville springs 11 which are disposed, under tension, between the armature disc 10 and the operating member 8 and which also serves to guide the armature disc 10 so as to prevent tilting thereof by the forces generated by the Belleville springs 11. The operating member 8 is provided with another stop 13 for the engagement of the spring arrangement 11.

The valve operating mechanism includes further a spring system comprising a lower compression spring 14 disposed around the valve stem at the side of the armature disc 10 adjacent the valve 4 and an upper compression spring 15 disposed on the opposite side of the armature that is on the side thereof remote from the valve 4. The springs 14 and 15 engage the armature disc 10 with oppositely directed forces by way of the valve support washer 5 and the stop 13, respectively.

For illustration purposes, FIG. 1 shows the springs 14 and 15 as coil springs. The lower compression spring 14 which will be termed valve closing spring provides a force in closing direction of the valve 4 whereas the upper spring 15 is so arranged that it exerts onto the valve 4 a force in opening direction and accordingly acts as a valve opening spring.

A cavity in the cylinder head 1 around the valve 4 receives a lower control magnet 16 and, spaced therefrom in the operating direction of the valve 4, an upper control magnet 17 which extends around the operating member 8.

The lower control magnet 16 is provided for opening the valve 4 and the upper control magnet 17 is provided for closing the valve 4. The magnets 16 and 17 are electromagnets of well known design having inner coils and outer pot-like magnetic body structures.

Both magnets are fixed in the cavity in the cylinder head. The magnets are so arranged that the armature which is held by the opposite compression springs in an intermediate position between the fully closed and fully open valve positions, is disposed about in the middle between the magnets when the magnets are de-energized. The valve closing spring 14 and the valve opening spring 15 are compressed during installation such that the spring system is balanced with the armature disposed in the middle between the magnets.

The Belleville spring 11 is so selected that, during compression upon installation, it engages the armature disc 10 with the stop 9 of the operating member 8 with a force which is smaller than the maximum force provided by the valve opening spring 15. As a result, the operating member 8 is always in firm engagement with the stem of the valve 4 without play even when the armature plate 10 is pulled upwardly, since the valve opening spring 15 compresses the Belleville spring 11 if necessary to maintain contact between the operating member 8 and the stem of the valve 4.

On the other hand, the pretensioning forces of the Belleville spring 11 are greater than the resultant of the opposite engagement forces of the spring system comprising the valve opening spring 15 and the valve closing spring 14. As a result, the armature disc 10 remains in force locking contact with the stop 9 of the guide member 8 essentially over the whole stroke of the armature. Consequently, relative movement between the armature disc 10 and the guide member 8, that is a separation of the armature disc 10 from the stop 9 occurs only when upper magnet 17 is energized and the armature disc 10 is in full engagement with the upper magnet 17. This position of the armature disc is shown in FIGS. 1 and 2 wherein the separation between the armature disc 10 and the stop 9 is clearly apparent.

Figure 2:
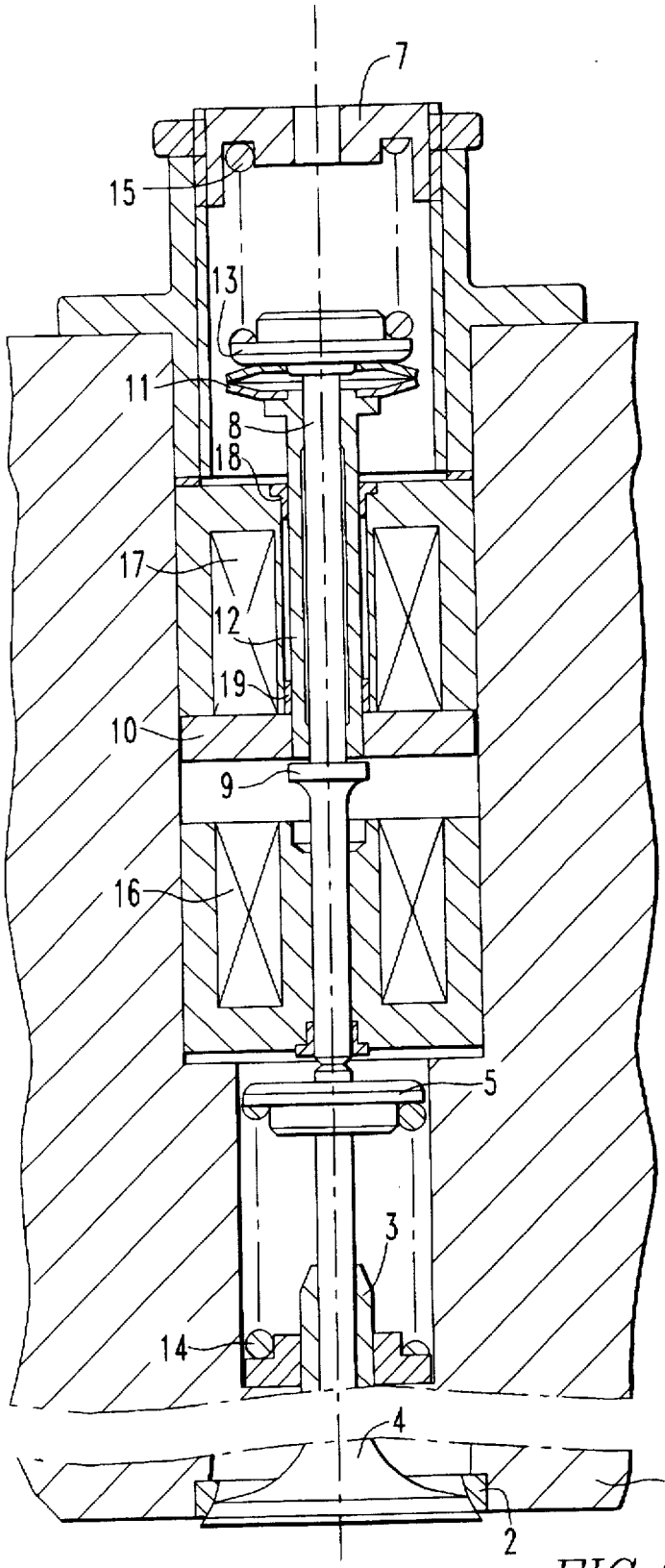
FIG. 2 is a cross-sectional view of another embodiment using oblong control magnets.

As shown in FIG. 2, the control magnets 16 and 17 do not need to be pot-shaped and the valve closing and valve opening springs 14 and 15 do not need to be disposed within the control magnets but can just as well be disposed without. The control magnets as shown in FIG. 2 are oblong in cross-section and have only a relatively small central passage sized to accommodate only the operating member 8 and the spacer sleeve 12, not the valve opening and closing springs 15 and 16.

If large magnetic forces are to be applied the smaller diameter, oblong magnets are more advantageous than the relatively large pot-like magnets since they require less space and are less expensive to manufacture than the pot-shaped magnets. They are particularly suitable for use with exhaust valves since the exhaust valves have to be opened against the relatively high gas pressure in the combustion chamber. On the other hand, pot-like control magnets are quite suitable for intake valves since the intake valves are subjected only to substantially lower gas pressures when they are opened at the end of the exhaust stroke.

The design features of the arrangement as shown in FIG. 2 are essentially the same as those of the arrangement shown in FIG. 1. For this reason, the same reference numerals are used. Also in the arrangement as shown in FIG. 2, there is an operating member 8 which is provided with a stop 5 and a spacer sleeve 12 which serves to support the operating member 8 and the disc-like armature plate 10 and which supports the Belleville springs 11. The arrangement according to FIG. 2 has additionally an upper bearing sleeve 18 and a lower bearing sleeve 19 for slideably supporting the spacer sleeve 12 wherein the upper and lower bearing sleeves 18 and 19 assume the function of the guide sleeve 6 of the arrangement of FIG. 1. The support provided by the two bearing sleeves 18, 19 has been found to be more advantageous since, with this arrangement in contrast to the arrangement of FIG. 1, the spacer sleeve 12 itself is slideably supported.

For a more detailed explanation of the operation of the arrangements shown in FIG. 1 and in FIG. 2, it is now assumed that the upper control magnet is energized. Then the armature disc 10 together with the operating member 8 is pulled upwardly and is engaged with the upper control magnet 17 in a valve closing position.

The valve 4 follows the operating member 8 under the force of the valve closing spring 14 until the valve 4 is seated on the valve seat ring 2. The valve 4 is however seated on the valve seat ring 2 before the armature disc 10 engages the control magnet 17. As a result, the operating member 8 would normally lift off the stem of the valve 4 as soon as the valve is seated on the valve seat ring 2 whereby the valve closing spring 14 would be uncoupled from the valve operating spring system. However, since the axial spring force of the Belleville spring 11 is smaller than the force exerted at this point by the valve opening spring 15, the Belleville spring 11 is compressed when the armature disc 10 is pulled into full engagement with the upper control magnet 17. Consequently, as soon as the valve 4 is seated on the valve seat ring 2, only the armature disc 10 with the spacer sleeve 12 continues to move upwardly into engagement with the upper control magnet 17 while the operating member 8 remains in engagement with the valve 4.

The spring forces which are generated between the armature disc 10, the operating member 8 and the stem of the valve 4 depend on the design or installation play, that is the play between the operating member 8 and the valve 4 when the armature disc 10 is in engagement with the upper control magnet 17 and the spring 15 is removed.

Consequently, the pre-tension force F holding the valve in a closed position comprises the sum of the pre-tension forces of the valve spring plus the force of the Belleville spring arrangement minus the force generated by the valve opening spring $$F_{valve\ closing}=F_{Belleville\ spring}+F_{closing\ spring}-F_{opening\ spring}$$

The play between the armature disc 10 and the stop 9 would lead to a corresponding stroke loss upon opening of the valve 4.

Since however, in the arrangement described, the force of the Belleville spring arrangement 11 is always larger than the maximally resulting spring force of the spring system, the armature disc 10 is in force-locking engagement with the stop 9 during almost all of the stroke of the valve. A play between the armature disc 10 and the stop 9 is only present after the valve 4 is seated on the valve seat ring 2 when the guide member 8 comes to a stand still and the armature disc 10 continues to move upwardly into engagement with the upper control magnet 17.

Therefore, thermal length changes and wear on the valve seat ring are taken into consideration in the description below only for the valve closing position when the armature disc 10 is fully pulled up into engagement with the control magnet 17. Furthermore, the operability of the whole system as well as the length adjustment between the operating member 8 and the valve 4 is of interest only in the valve closing position since play is present only in this position when the armature disc is in engagement with the control magnet 17.

As described already earlier, there is a gap between the armature disc 10 and the stop 9 of less than 1 mm when the armature disc 10 is pulled fully upwardly into engagement with the control magnet 17. If the valve stem extends further upwardly as a result of the valve wearing into the valve seat ring or because of thermal expansion of the valve stem the operating member 8 is also moved upwardly because of the force of the valve closing spring 14 and the force of the Belleville spring arrangement 11 whereby the Belleville spring arrangement 11 is expanded by a small amount. The valve opening spring is further compressed by the same small amount which results in a reduction of the size of the gap between the armature disc 10 and the stop 9.

If on the other hand, the cylinder head 1 expands to a greater degree than the valve 4 or rather its stem, the force transmitted by the valve stem to the operating member 8 drops since the valve stem cannot follow the upward movement of the magnet and together therewith the armature disc and the spacer element 12. As a result, the spring arrangement 11 is further compressed while the operating member 8 is held in engagement with the valve stem by the force of the valve opening spring 15. The closing spring force effective on the valve stem is sufficient to hold the operating member 8 in its position as long as the control magnet 17 is energized and holds the armature disc 10. In this position, there is a force equilibrium between the three springs structures 11, 14 and 15. The gap between the armature disc 10 and the stop 9 is slightly increased and the Belleville spring arrangement 11 is slightly more compressed, but the operating member 8 remains in contact with the valve stem.

If now the control magnet 17 is de-energized the whole arrangement including the valve 4 moves downwardly under the force of the valve opening spring 15. The armature disc 10 at the same time makes an additional move relative to the operating member 8 until, under the force of the Belleville spring arrangement 11, it engages the stop 9 on the guide member 8.

As soon as the armature disc 10 has reached the stop 9 the whole system moves down in valve opening direction in unison since the tension force of the Belleville springs is substantially greater than the force resultant of the valve opening spring 15 and the valve closing spring 14.

The armature disc 10 is pulled toward its lower end position by the lower control magnet 16 which is energized when or after the upper control magnet 17 is de-energized. Upon de-energization of the lower control magnet 16 the whole system moves again upwardly until the valve 4 is seated on the valve seat ring 2. From this point on only the armature disc 10 is pulled up against the force of the Belleville springs 11 into engagement with the upper control magnet 17 which again has been energized. The operating member 8 remains always in firm contact with the stem of the valve 4.

What is claimed is:

1. An electromagnetic operating arrangement for actuating intake and exhaust valves of internal combustion engines, each valve having a valve stem with a valve closing spring engaging said valve stem for biasing said valve into a valve closing position, a valve operating member movably supported in axial alignment with said valve stem, an operating member spring engaging said valve operating member so as to bias it into engagement with said valve stem, an armature disc supported on said valve operating member, control magnets arranged in spaced relationship at opposite sides of said armature disc for holding said armature disc in an open valve or closed valve position respectively, said armature disc being movably supported on said valve operating member and said valve operating member having a first stop adjacent said armature disc and a spring arrangement for forcing said armature disc toward said stop and into engagement with said valve operating member, said operating member spring exerting a spring force when said valve is in the closed position and said armature disc is in engagement with the respective control magnet which is greater than the spring force exerted by said spring arrangement wherein said valve operating member always remains in force-transmitting contact with said valve.

2. An arrangement according to claim 1, wherein said spring arrangement comprises at least one Belleville spring which is disposed in a compressed state between said armature disc and a second stop formed on said valve operating member.

3. An arrangement according to claim 1, wherein said first stop is axially adjustably mounted on said valve operating member to permit adjustment of the axial movability of said armature disc relative to said valve operating member.

4. An arrangement according to claim 1, wherein a spacer sleeve is disposed between said armature disc and said spring arrangement.

5. An arrangement according to claim 1, wherein said control magnets are disposed around said valve closing spring and said valve operating member spring, respectively.

6. An arrangement according to claim 4, wherein said control magnets are disposed axially between said valve closing spring and said valve operating member spring and said spacer sleeve extends from said armature disc which is disposed between said control magnets through the valve closing control magnet to said spring arrangement which is disposed above said valve closing magnet.

* * * * *